US007086664B2

(12) United States Patent
Voegeli, Jr. et al.

(10) Patent No.: US 7,086,664 B2
(45) Date of Patent: Aug. 8, 2006

(54) JACK HANDLE WITH DETACHABLE JACK DRIVER

(75) Inventors: Anthony P. Voegeli, Jr., Fort Wayne, IN (US); Don Johnson, Fort Wayne, IN (US); John Joseph McDonald, Albion, IN (US); Bruce Daniel Kingsbury, Fort Wayne, IN (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 127 days.

(21) Appl. No.: 10/713,599

(22) Filed: Nov. 14, 2003

(65) Prior Publication Data

US 2005/0104352 A1 May 19, 2005

(51) Int. Cl.
*B66F 7/14* (2006.01)

(52) U.S. Cl. ..... 280/769; 16/422; 254/DIG. 3

(58) Field of Classification Search ..... 280/769; 16/422; 254/DIG. 3; 24/595.1, 594.1
See application file for complete search history.

(56) References Cited

U.S. PATENT DOCUMENTS 3,484,910 A * 12/1969 Gossling ..... 16/422
4,920,592 A 5/1990 Scott
5,237,890 A * 8/1993 Gill ..... 74/546
5,301,389 A * 4/1994 Engel et al. ..... 16/422
5,381,707 A 1/1995 Gill
5,433,127 A 7/1995 Messier
5,638,577 A 6/1997 Gooding et al.
5,878,627 A 3/1999 McMurtrey
6,070,491 A 6/2000 Claudio et al.
6,076,424 A 6/2000 McMurtrey et al.
6,178,848 B1 1/2001 Lowe
6,237,894 B1 5/2001 Cotner et al.
6,637,908 B1 * 10/2003 Hung ..... 362/109

* cited by examiner

*Primary Examiner*—Jeff Restifo
(74) *Attorney, Agent, or Firm*—Richard M. Mescher; Porter Wright Morris & Arthur; Dean Watson

(57) ABSTRACT

A jack handle includes a handle arm having first and second ends, a jack driver having a coupling shaft, and a spring clip detachably securing the jack driver to the handle arm. The first end of the handle arm forms a socket receiving the coupling shaft. The spring clip has a protrusion resiliently deflectable between a locking position interlocking with the coupling shaft to secure the jack driver to the handle arm and a releasing position free of the coupling shaft such that the jack driver is released from the handle arm. Preferably, the spring clip encircles the periphery of the handle arm at the socket, the handle arm has an opening at the socket, and the protrusion of the clip extends through the opening and into the groove to interlock the jack driver with the handle arm.

20 Claims, 5 Drawing Sheets

JACK HANDLE WITH DETACHABLE JACK DRIVER

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to portable lifting jacks for motor vehicles, and more particularly, an improved handle for actuating such jacks.

BACKGROUND OF THE INVENTION

A portable jack is often stored in a motor vehicle to enable a driver to lift the vehicle to effect emergency repairs such as, for example, changing a tire. These jacks can be of either a scissors type or a telescoping type and normally utilize a screw drive. In both cases, a rotary force is applied to the drive screw to either raise or lower the jack, and thus the vehicle, depending on whether the rotary force is either clockwise or counterclockwise. The rotary force is typically applied by a jack handle engaging the drive screw. The operator manually rotates the jack handle in the desired direction to raise or lower the jack.

A tire carrier often stores a spare tire under a rear end of the motor vehicle so that the space tire does not require interior storage space. These tire carriers often utilize a screw drive wherein a rotary force is applied to a coupling or drive element on the drive screw to either raise or lower the spare tire depending on whether the rotary force is either clockwise or counterclockwise. The rotary force is often applied by a carrier handle engaging the drive screw. The operator manually rotates the carrier handle in the desired direction to raise or lower the jack.

There is continuing emphasis by automobile manufacturing companies to reduce the size, weight, and/or cost of motor vehicle components. In turn, jack and tire carrier manufacturing companies are continuously attempting to reduce the size, weight, and/or cost of portable jacks and tire carriers while still providing adequate strength to bear required loads as well as other operating properties. Accordingly, there is a continuing need for an improved jack handle or use with portable jacks.

SUMMARY OF THE INVENTION

The present invention provides a jack handle which overcomes at least some of the above-noted problems of the related art. According to the present invention, a jack handle comprises, in combination, a handle arm having first and second ends, a jack driver, and a coupling removably securing the jack driver to the first end of the handle arm.

According to another aspect of the present invention, a jack kit for a motor vehicle includes, in combination, a portable jack having a drive screw rotatable to raise and lower the portable jack and a tire carrier having a drive shaft rotatable to raise and lower the tire carrier. A handle arm is provided which has first and second ends. A jack driver is adapted to cooperate with the drive screw to rotate the drive screw upon rotation of the jack driver. A coupling interchangeably secures the jack driver and the drive shaft to the first end of the handle arm to selectively rotate the drive screw and the drive shaft upon rotation of the handle arm.

According to yet another aspect of the present invention, a jack handle includes, in combination, a handle arm having first and second ends, a jack driver having a coupling shaft, and a spring clip. The first end of the handle arm forms a socket receiving the coupling shaft. The spring clip has a protrusion resiliently deflectable between a locking position interlocking with the coupling shaft to secure the jack driver to the handle arm and a releasing position free of the coupling shaft such that the jack driver is released from the handle arm.

From the foregoing disclosure and the following more detailed description of various preferred embodiments it will be apparent to those skilled in the art that the present invention provides a significant advance in the technology of portable jacks. Particularly significant in this regard is the potential the invention affords for providing a high quality, light weight, multi-functional, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
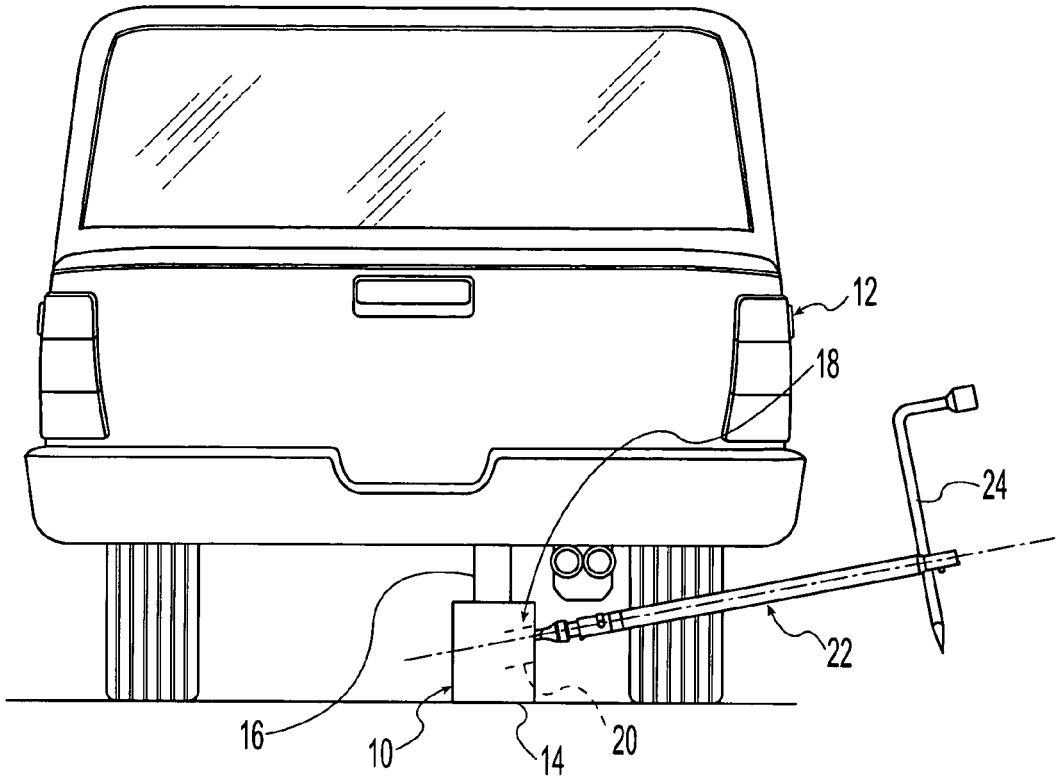
FIG. 1 is an elevational view of a portable jack according a preferred embodiment of the present invention which is positioned to lift a motor vehicle.

It should be understood that the appended drawings are not necessarily to scale, presenting a somewhat simplified representation of various preferred features illustrative of the basic principles of the invention. The specific design features of the jack as disclosed herein, including, for example, specific dimensions, orientations, and shapes of the jack driver and spring clip. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the jack illustrated in the drawings. In general, up or upward refers to an upward direction generally in the plane of the paper in FIG. 1 and down or downward refers to a downward direction generally in the plane of the paper in FIG. 1. Also in general, forward or front refers to a direction toward the front of the motor vehicle and rearward or rear refers to a direction toward the back of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved portable jack disclosed herein. The following detailed discussion of various alternative and preferred embodiments will illustrate the general principles of the invention with reference to a portable jack for a motor vehicle. Other embodiments suitable for other applications will be apparent to those skilled in the art given the benefit of this disclosure.

Referring now to the drawings, FIG. 1 show a portable jack 10 according to a preferred embodiment of the present invention positioned under a motor vehicle 12, such as an automobile. While the illustrated embodiments of the present invention are particularly adapted for use with an automobile, it is noted that the present invention can be utilized with any motor vehicle having a use for a portable jack including trucks, buses, vans, recreational vehicles, earth moving equipment and the like, off road vehicles such as dune buggies and the like, air borne vehicles, and water borne vehicles.

The illustrated portable jack 10 includes a stationary base 14 for engaging a ground support to support the portable jack 10 on the ground support, a load rest 16 for positioning under and engaging a motor vehicle 12 or other load to be raised and lowered by the portable jack 10, and a drive assembly 18 for moving the load rest 16 between raised and lowered positions to selectively raise and lower the motor vehicle 12. The drive assembly 18 includes a drive screw or shaft 20, a jack handle 22, and a handle or lug wrench 24. The drive shaft 20 is operatively connected to the portable jack 10 so that rotation of the drive shaft 20 raises and lowers the portable jack 10 in a conventional manner. The drive shaft 20 can be configured in any suitable manner to cooperate with the jack handle 22 as described in more detail hereinbelow.

As best shown in FIGS. 4 to 7, the illustrated jack handle 22 includes a handle arm 26, a jack driver 28, a first coupling 30 removably securing the jack driver 28 to the handle arm 26, and a second coupling 32 removably securing the lug wrench 24 or other handle member to the handle arm 26. The illustrated handle arm 26 is an elongate tube having a first end portion 34 adapted to be removably secured to the jack driver 28 and a second end potion 36 adapted to be removably secured to the lug wrench 24. The illustrated central portion 38 is a hollow tube having a circular-shaped cross-section but can alternatively be solid and/or have other geometric shapes.

The illustrated first end portion 34 is an enlarged hollow tube section having a square-shaped cross-section to form a socket 40 sized and shaped for receiving an end of the jack driver 28. The socket 40 forms a hollow cavity which is open at the free end of the handle arm 26. The square-shaped cross section is desirable to transfer rotational motion of the handle arm 26 to the jack driver 28 but other suitable shapes and/or connections can alternatively be utilized. Opposite sides of the socket 40 are provided with coaxial openings 42 which open into the socket 40 and are sized and shaped to cooperate with the first coupling 30 as described in more detail hereinafter.

The illustrated second end portion 36 is a reduced hollow tube section having a square-shaped cross-section to form a shaft 44 sized and shaped for receiving the lug wrench 24 thereon. The square-shaped cross section is desirable to transfer rotational motion of the lug wrench 24 to the handle arm 26 but other suitable shapes and/or connections can alternatively be utilized. A side of the shaft 44 is provided with an opening 46 which open into the hollow interior of the shaft 44 and is sized and shaped to cooperate with the second coupling 32 as described in more detail hereinafter.

It is noted that while the expanded and reduced end portions 34, 36 of the handle arm 26 are sized such that the jack driver 28 and lug wrench 24 can only be secured to the proper end of the handle arm 26, the end portions 34, 36 can be formed in other manners such as, for example, one or both enlarged, one or both reduced, one or both neither reduced or enlarged, or any combination thereof. The handle arm 26 is preferably formed of a suitable rigid material such as, for example, steel but can alternatively be formed of other suitable materials.

The jack driver 28 extends into the socket 40 at the first end portion 34 of the handle arm 26 and is removably secured to the handle arm 26 by the first coupling 30 so that the jack driver 28 can be easily attached and detached from the handle arm 26 when desired by the operator. The illustrated first coupling 30 includes a first spring clip 48 which can be manually deflected to attach and detach the jack driver 28. It is noted that the first coupling 30 can alternatively be any other suitable means of removably coupling the jack driver 28 to the handle arm 26 such as, for example, cam lock, thumb screw, clamp, lock pin, or the like.

Figure 7:
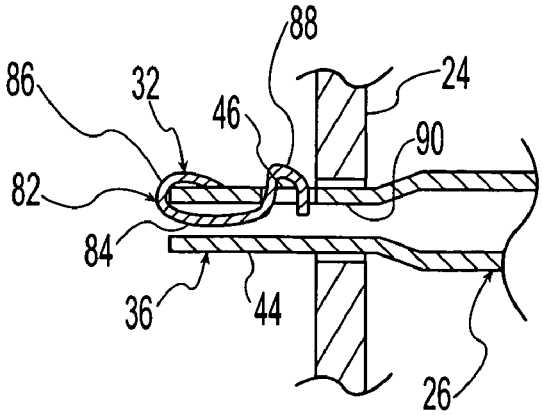
FIG. 7 is sectional view taken along line 7—7 of FIG. 4.
Figure 8:
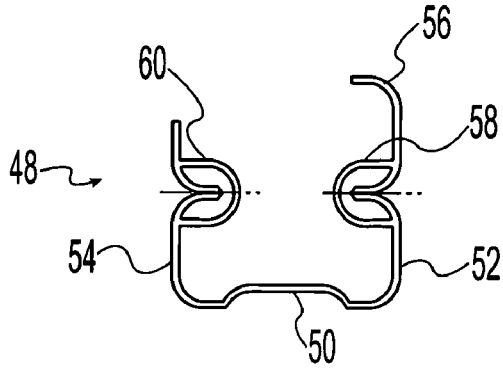
FIG. 8 is an end elevational view of a clip of the jack handle of FIGS. 3 and 4.
Figure 9:
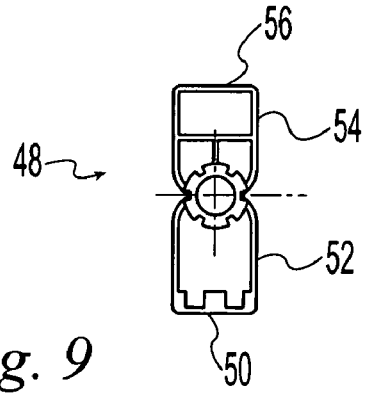
FIG. 9 is a side elevational view of the clip of FIG. 8.

As best shown in FIGS. 7 and 8, the illustrated first spring clip 48 is sized and shaped to substantially extend about or encircle the exterior periphery of the first end portion 34 of the handle arm 26. The first spring clip 48 preferably extends about at least one half of the periphery of the first end portion 34 and more preferably extends about at least three-fourths the periphery of the first end portion 34. The illustrated first spring clip 48 includes a base 50 sized to extend across the bottom wall of the handle arm first end portion 34, a first and second sides 52, 54 extending perpendicularly from opposed ends of the base 50 and sized to substantially extend across sides walls of the handle arm first end portion 34, and a leg or flange 56 extending perpendicularly from an end of the first side 52 opposite the base 50 and sized to extend partially across the top wall of the handle arm first end portion 34. It is noted that when desired, the second side 54 can also be provided with a leg or flange 56. The first and second sides 52, 54 are provided with inwardly extending first and second buttons or protrusions 58, 60. The illustrated first and second protrusions 58, 60 coaxially extend along a lateral axis perpendicularly extending between the first and second sides 52, 54. The first and second protrusions 58, 60 are sized and shaped to cooperate with the opposed openings 42 formed in the handle arm first end portion 34. The illustrated first and second protrusions 58, 60 are generally dome-shaped, that is cylindrical with a rounded end, but it is noted that other suitable shapes can be utilized within the scope of the present invention. It is also noted that while the illustrated first spring clip 48 has two protrusions 58, 60, a greater or lesser number of protrusions 58, 60 can be utilized within the scope of the present invention. The first spring clip 48 is preferably formed of a suitable resiliently deflectable material such as, for example, spring steel. The illustrated first spring clip 48 is formed from a single strip of spring steel so that the base 50, sides 52, 54, leg 56, and protrusions 58, 60 are unitary but other manufacturing methods can be utilized within the scope of the present invention.

As best shown in FIGS. 3 to 6, the first spring clip 48 extends substantially about the exterior periphery of the first end portion 34 of the handle arm 26. The first spring clip 48 is axially positioned along the length of the handle arm 26 at the openings 42 such that the first and second protrusions 58, 60 extend through the openings 42 and into the socket 40 formed by the first end portion 34 of the handle arm 26. Within the socket 40, the protrusions 58, 60 cooperate with the jack driver 28 to removably secure the jack driver 28 to the handle arm 26 as described in more detail hereinafter.

Figure 10:
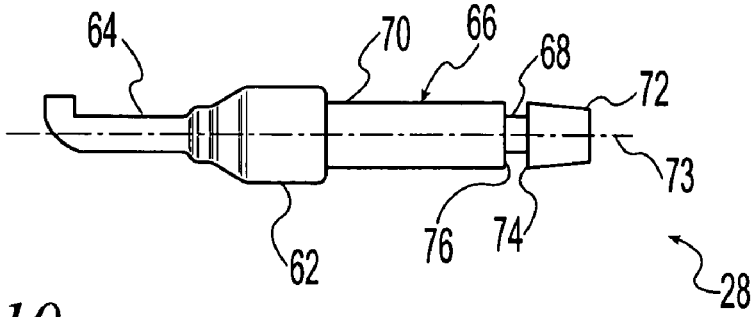
FIG. 10 is a top plan view of a jack driver of the jack handle of FIGS. 3 and 4.
Figure 11:
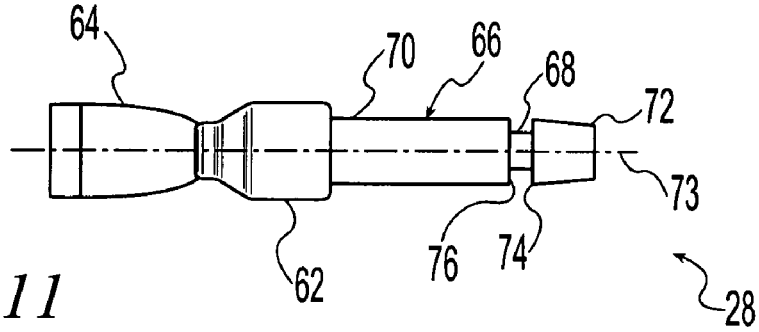
FIG. 11 is an side elevational view of the jack driver of FIG. 10.

As best shown in FIGS. 10 and 11, the illustrated jack driver 28 includes a main body 62, a hook 64, and a coupling shaft 66. The hook 64 extends from a first axial end of the main body 62 and is sized and shaped to cooperate with the drive shaft 20 of the portable jack 10 in a known manner. The coupling shaft 66 axially extends from a second axial end of the main body 62. A circumferentially extending groove 68 is formed between a main portion 70 and an end portion 72. The illustrated groove 68 entirely extends about the outer periphery of the coupling shaft 66 and encircles a longitudinal axis 73 of the jack driver coupling shaft 66. The groove 68 is sized and shaped to provide opposite facing first and second abutments 74, 76 which cooperate with the protrusions 58, 60 of the first spring clip 48. The main portion 70 is sized and shaped to be closely received within the socket 40 of the first end portion 34 of the handle arm 26. The illustrated main portion 70 is square-shaped in cross-section but other suitable shapes can be utilized. The end portion 34 is tapered to ease insertion of the coupling shaft 66 into the socket 40 and to assist deflection of the first spring clip 48 upon insertion of the jack driver 28. The illustrated end portion 72 is circular in cross section so that the end portion 72 is generally frusto-conically-shaped but other suitable shapes can be utilized. The illustrated jack driver 28 is formed of solid material but alternatively the jack driver 28 or a portion of the jack driver 28 can be hollow such as, for example, the coupling shaft 66 could be tubular. The jack driver 28 can be formed of any suitable rigid material such as, for example, steel.

To attach the jack driver 28 to the handle arm 26, the coupling shaft 66 is inserted into the socket 40 formed by the first end portion 34 of the handle arm 26 and a force is manually applied in the axial direction. When the tapered end portion 34 engages the protrusions 58, 60 of the first spring clip 48, the tapered surface deflects the protrusions 58, 60 radially outward from a locking position to a releasing position so that the end portion 72 of the coupling shaft 66 can pass the protrusions 58, 60. Once the groove 68 reaches the protrusions 58, 60, the protrusions 58, 60 resiliently snap back inward to their locking position and into the groove 68. With the protrusions 58, 60 in the locking position and in the groove 68, the jack driver 28 is secured to the handle arm 26 because the protrusions 58, 60 engage the abutments 74. 76 formed by the groove 68 to prevent substantial movement of the jack driver 28 in either axial direction relative to the handle arm 26. To detach the jack driver 28, the operator grasps the leg 56 of the first spring clip 48 and pulls outwardly to outwardly deflect the protrusions 58, 60 from their locking position to their releasing and out of the groove 68 and simultaneously pulls axially outward on the jack driver 28 to remove the coupling shaft 66 from the socket 40. The protrusions 58, 60 of the first spring clip 48 resiliently return to their locking position when the operator releases the leg 56 and the coupling shaft 66 is moved past the protrusions 58, 60.

Figure 12:
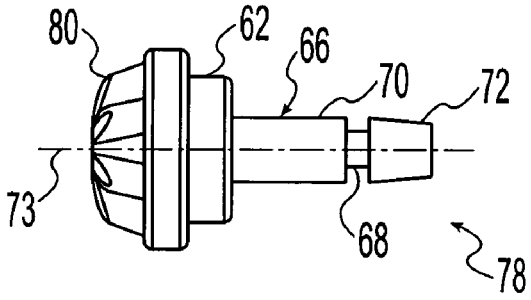
FIG. 12 is a top plan view of an alternative jack driver for use with the jack handle of FIGS. 3 and 4.
Figure 13:
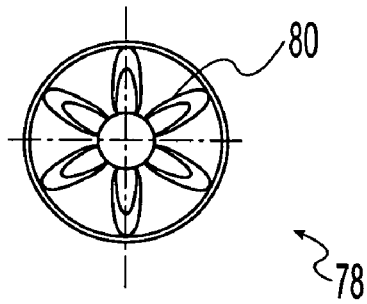
FIG. 13 is an end elevational view of the jack driver of FIG. 12.

It is noted that the jack driver 28 can have many alternative configurations to cooperate with the drive shaft 20 of the portable jack 10. A best shown in FIGS. 12 and 13, an alternative jack driver 78 includes the main body 62, a gear 80, and the coupling shaft 66. The gear 80 extends from a first axial end of the main body 62 and is sized and shaped to cooperate with the drive shaft 20 of the portable jack 10 in a known manner. The coupling shaft 66 is identical to the coupling shaft 66 of the first embodiment of the jack driver 28. The alternative jack driver 78 illustrates that the jack driver 28, 78 can have any desirable interface for cooperating with the drive shaft 20 of the portable jack 10.

The lug wrench 24 extends over the shaft 44 at the second end portion 36 of the handle arm 26 and is removably secured to the handle arm 26 by the second coupling 32 so that the lug wrench 24 can be easily attached and detached from the handle arm 26 when desired by the operator. The illustrated second coupling 32 includes a second spring clip 82 which can be manually deflected to attach and detach the lug wrench 24 from the handle arm 26. It is noted that the second coupling 32 can alternatively be any other suitable means of removably coupling the lug wrench 24 or other handle means to the handle arm 26 such as, for example, cam lock, thumb screw, clamp, lock pin, or the like. It is also noted that a fixed handle means can be alternatively fixed to the handle arm 26.

As best shown in FIG. 7, the illustrated second spring clip 82 is sized and shaped to extend within the second end portion 36 of the handle arm 26 from the edge of the second end portion 36 to the opening 46 formed in the second end portion 36. The second spring clip 82 includes a base 84 sized to extend from the edge to the opening and a leg or flange 86 extending from an end of the base 84 and around the edge of the second end portion 36. The base 84 is provided with an outwardly extending button or protrusion 88. The protrusion 88 is sized and shaped to cooperate with the opening 46 formed in the handle arm second end portion 36. The illustrated protrusion 88 is generally dome-shaped, that is, cylindrical with a rounded end, but it is noted that outer suitable shapes can be utilized within the scope of the present invention. It is also noted that while the illustrated second spring clip 82 has a single protrusion 88, a greater or lesser number of protrusions 88 can be utilized within the scope of the present invention. The second spring clip 82 is preferably formed of a suitable resiliently deflectable material such as, for example, spring steel. The illustrated second spring clip 82 is formed from a single strip of spring steel so that the base 84, leg 86, and protrusion 88 are unitary but other manufacturing methods can be utilized within the scope of the present invention.

The second spring clip 82 extends within the second end portion 36 of the handle arm 26. The second spring clip 82 is positioned along the length of the handle arm 26 such that the leg 86 extends around the edge to secure the second spring clip 82 in place and the protrusion 88 is at the opening 46 such that the protrusion 88 extends through the opening 46 and beyond the outer surface of the second end portion 36 of the handle arm 26. The protrusion 88 cooperates with the lug wrench 24 to removably secure the lug wrench 24 to the handle arm 26 as described in more detail hereinafter.

To attach the lug wrench t24 o the handle arm 26, the second end portion 36 of the handle arm 26 is inserted into a transverse opening 90 in the lug wrench 24 and a force is applied in the axial direction of the second end portion 36. When the second end portion 36 engages the protrusion 88 of the second spring clip 82, the operator manually deflects the protrusion 88 radially inward from a locking position to a releasing position so that the lug wrench 24 can pass over the protrusion 88. Once the lug wrench is past the protrusion 88, the protrusion 88 resiliently snaps back outward to its locking position. With the protrusion 88 in its locking position, the lug wrench i24 s secured to the handle arm 26 because the lug wrench 24 engages the protrusion 88 to prevent movement of the lug wrench 24 off the handle arm 26. To detach the lug wrench 24, the operator presses the protrusion 88 inward and pulls while simultaneously pulling the lug wrench 24 axially outward off the handle arm 26. The protrusion 88 of the second spring clip 82 resiliently returns to its locking position once the lug wrench 24 passes the protrusion 88.

As best shown in FIG. 1, the jack handle 22 is used to operate the portable jack 10 to raise and lower the motor vehicle 12. Once the portable jack 10 is positioned below the motor vehicle 12 at a suitable location, the jack driver 28 of the jack handle 22 is engaged with the drive shaft 20 of the portable jack 10. The operator then manually rotates the lug wrench 24 in the appropriate direction to rotate the jack handle 22 and the drive shaft 20 and raise the portable jack 10 and the motor vehicle 12. To lower the portable jack 10 and the motor vehicle 12, the lug wrench 24 is rotated in the opposite direction. It is noted that depending on the position of the portable jack 10 under the motor vehicle 12, it may be desirable to provide an extension tube between the jack handle 22 and the lug wrench 24. Such an extension tube would have a first end with a socket adapted to mate with the second coupling 32 of the handle arm 26 and a second end with a second coupling 32, just like the second end of the handle arm 26, to mate with the lug wrench 24.

Figure 2:
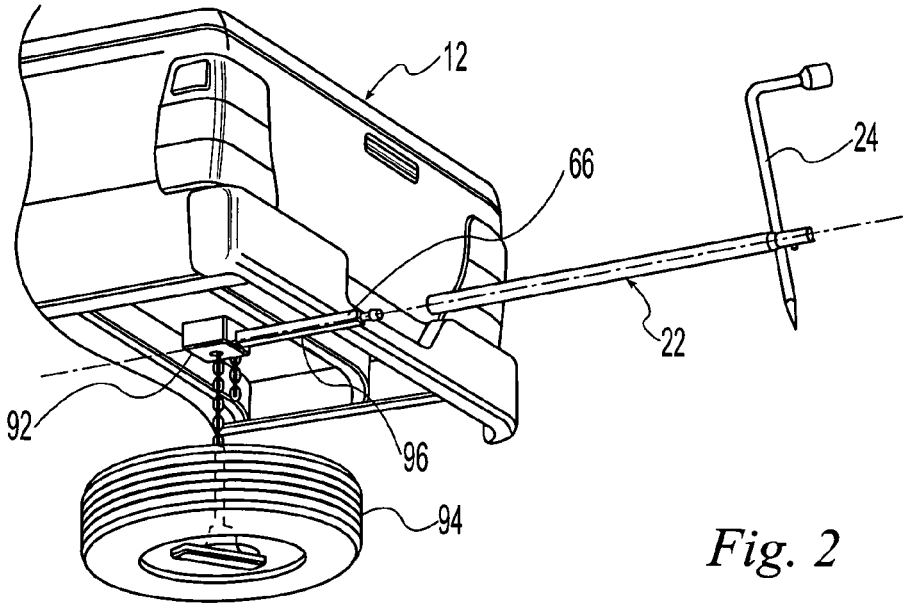
FIG. 2 is perspective view of a tire carrier according to a preferred embodiment of the present invention which is positioned to raise a spare tire of a motor vehicle.
Figure 3:
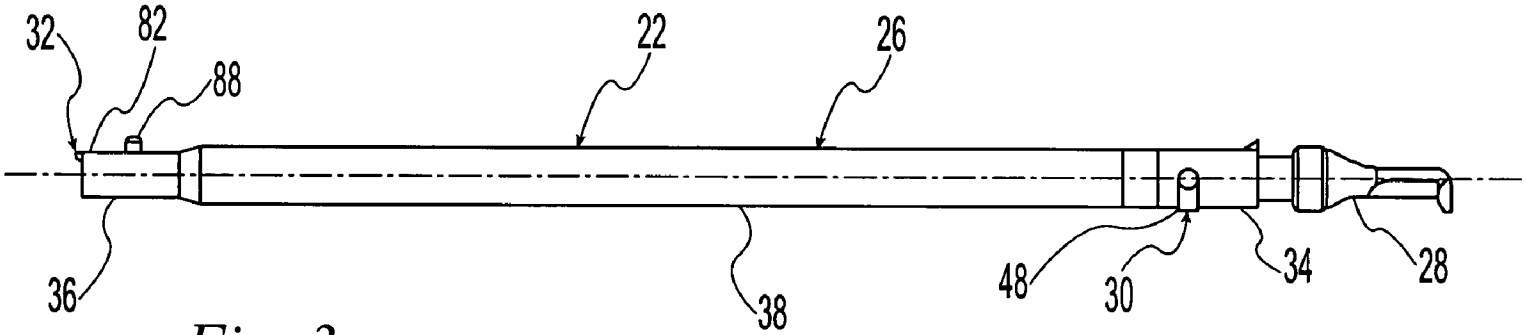
FIG. 3 is side elevational view of a jack handle the portable jack of FIG. 1.
Figure 4:
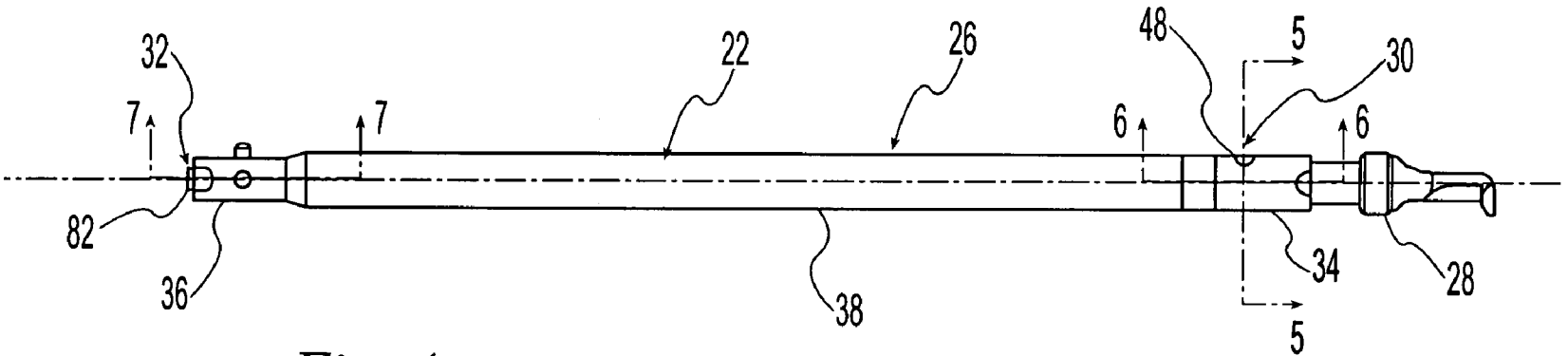
FIG. 4 is a top plan view of the jack handle of FIG. 3.
Figure 5:
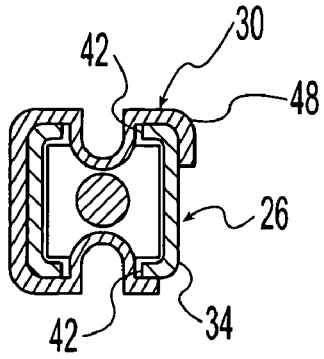
FIG. 5 is a sectional view taken along line 5—5 of FIG. 4.
Figure 6:
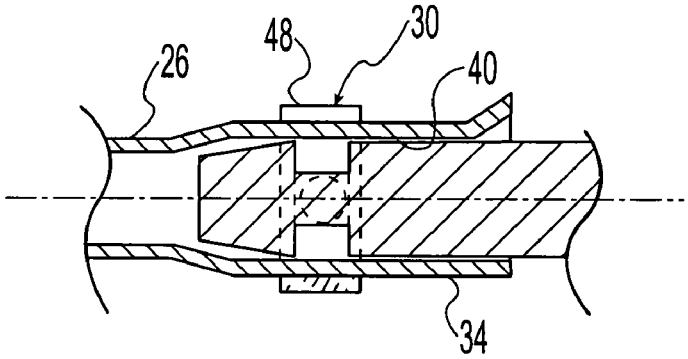
FIG. 6 is sectional view taken along line 6—6 of FIG. 4.
Figure 14:
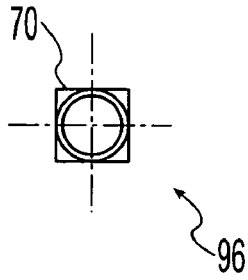
FIG. 14 is an end elevational view of a drive shaft of the tire carrier of FIG. 2.
Figure 15:
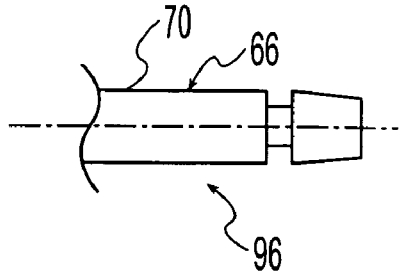
FIG. 15 is a side elevational view of the drive shaft of FIG. 14.

As best shown in FIG. 2, the jack handle 22 can also be used to operate a tire carrier 92 to raise and lower a spare tire 94. The tire carrier 92 includes a drive screw or shaft 96 having a coupling shaft 66 at its free end so that the spare tire 94 raises and lowers when the coupling shaft 66 is rotated. As best shown in FIGS. 14 and 15, the coupling shaft 66 is substantially the same as the coupling shaft 66 of the jack driver 28 described above and includes the main portion 70, the end portion 72, and the groove 68. To lower the spare tire, 94 the handle arm 26 is secured to the coupling shaft 66 by inserting the coupling shaft 66 into the socket 40 of the handle arm first end portion 34 in the same manner as attaching the jack driver 28 described hereinabove. Once the handle arm 26 is secured to the coupling shaft 66, the operator manually rotates the lug wrench 24 in the appropriate direction and the tire carrier 92 lowers the spare tire 94. To raise the spare tire 94, the lug wrench 24 is rotated in the opposite direction. The handle arm 26 is then removed from the coupling shaft 66 in the same manner as described hereinabove to remove the jack driver 28.

It is apparent from the foregoing disclosure that the jack handle 22 according to the present invention provides manufacturing benefits because common components can be utilized for different styles of portable jacks 10 in that a common handle arm 26 is used with different jack drivers 28, 78. It is also apparent from the foregoing disclosure that the jack handle 22 according to the present invention can be utilized to interchangeably operate both the portable jack 10 and the tire carrier 92 of a motor vehicle 12 resulting in a reduction of the number of operating tools needed to be provided and stored in the motor vehicle 12.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the jack driver 28, 78 and the spring clips 48, 82 can each have many different configurations and can be formed of many different materials. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A jack handle comprising, in combination:

a handle arm having first and second ends;

a jack driver; and a coupling removably securing the jack driver to the first end of the handle arm;

wherein the jack driver includes a coupling shaft having a groove encircling a longitudinal axis of the coupling shaft;

wherein the groove extends radially inwardly about a periphery of the coupling shaft to form opposite and axially-facing first and second abutments; and wherein the coupling includes a clip operatively secured to the handle arm and having at least one protrusion extending into the groove to interlock the jack driver and the handle arm and limit axial movement therebetween by engagement between the protrusion and the first and second abutments.

2. The jack handle according to claim 1, wherein the first end of the handle arm forms a socket receiving the coupling shaft.

3. The jack handle according to claim 2, wherein the groove is located within the socket when the coupling shaft is within the socket.

4. The jack handle according to claim 3, wherein the clip is a spring clip, the protrusion is resiliently deflectable between a locking position wherein protrusion extends into the groove and the jack driver is secured to the handle arm and a releasing position wherein the protrusion is out of the groove and the jack driver is released from the handle arm, and the end of the coupling shaft is sized and shaped to move the protrusion from the locking position to the releasing position as the coupling shaft is inserted into the socket and to permit the protrusion to resiliently return to the locking position when the groove is axially aligned with the protrusion.

5. The jack handle according to claim 1, wherein the clip has a pair of the protrusions which interlock opposite lateral sides of the groove.

6. The jack handle according to claim 1, wherein the clip is a spring clip and the protrusion is resiliently deflectable between a locking position wherein the jack driver is secured the handle arm and a releasing position wherein the jack driver is released from the handle arm.

7. The jack handle according to claim 1, wherein the clip substantially encircles a periphery of the handle arm.

8. A jack handle comprising, in combination:

a handle arm having first and second ends;

a jack driver;

a coupling removably securing the jack driver to the first end of the handle arm;

wherein the coupling includes a clip having at least one protrusion interlocking with the jack driver to secure the jack driver to the handle arm;

wherein the clip substantially encircles a periphery of the handle arm; and wherein the jack driver includes a coupling shaft having a groove, the first end of the handle arm forms a socket receiving the coupling shaft, the clip encircles the periphery of the handle arm at the socket, the handle arm has an opening at the socket, and the protrusion of the clip extends through the opening and into the groove to interlock the jack driver with the handle arm.

9. A jack kit for a motor vehicle comprising, in combination:

a portable jack having a drive screw rotatable to raise and lower the portable jack;

a tire carrier having a drive shaft rotatable to raise and lower the tire carrier;

a handle arm having first and second ends;

a jack driver adapted to cooperate with the drive screw to rotate the drive screw upon rotation of the jack driver; and a coupling interchangeably securing the jack driver and the drive shaft to the first end of the handle arm to selectively rotate the drive screw and the drive shaft upon rotation of the handle arm wherein the jack driver and the drive shaft each include a coupling shaft having a groove encircling a longitudinal axis of the coupling shaft;

wherein the groove extends radially inwardly about a periphery of the coupling shaft to form opposite and axially-facing first and second abutments; and wherein the coupling includes a clip operatively secured to the handle arm and having at least one protrusion extending into the groove to interchangeably interlock the jack driver and the drive shaft with the handle arm and limit axial movement therebetween by engagement between the protrusion and the first and second abutments.

10. The jack kit for a motor vehicle according to claim 9, wherein the first end of the handle arm forms a socket interchangeably receiving the coupling shafts of the jack driver and the drive shaft.

11. The jack handle according to claim 10, wherein the groove is located within the socket when the coupling shaft is within the socket.

12. The jack handle according to claim 11, wherein the clip is a spring clip, the protrusion is resiliently deflectable between a locking position wherein protrusion extends into the groove and the jack driver and drive shaft are interchangeably secured to the handle arm and a releasing position wherein the protrusion is out of the groove and the jack driver and the drive shaft are interchangeably released from the handle arm, and the end of the coupling shaft is sized and shaped to move the protrusion from the locking position to the releasing position as the coupling shaft is inserted into the socket and to permit the protrusion to resiliently return to the locking position when the groove is axially aligned with the protrusion.

13. The jack kit for a motor vehicle according to claim 9, wherein the clip has a pair of the protrusions which interchangeably interlocks opposite lateral sides of the jack driver and opposite sides of the drive shaft.

14. The jack kit for a motor vehicle according to claim 9, wherein the clip is a spring clip and the protrusion is resiliently deflectable between a locking position wherein the jack driver and drive shaft are interchangeably secured the handle arm and a releasing position wherein the jack driver and drive shaft are released from the handle arm.

15. The jack kit for a motor vehicle according to claim 9, wherein the clip substantially encircles a periphery of the handle arm.

16. A jack kit for a motor vehicle comprising, in combination:

a portable jack having a drive screw rotatable to raise and lower the portable jack;

a tire carrier having a drive shaft rotatable to raise and lower the tire carrier;

a handle arm having first and second ends;

a jack driver adapted to cooperate with the drive screw to rotate the drive screw upon rotation of the jack driver;

a coupling interchangeably securing the jack driver and the drive shaft to the first end of the handle arm to selectively rotate the drive screw and the drive shaft upon rotation of the handle arm;

wherein the coupling includes a clip having at least one protrusion interchangeably interlocking with the jack driver to secure the jack driver to the handle arm and the drive shaft to secure the drive shaft to the handle arm;

wherein the clip substantially encircles a periphery of the handle arm; and wherein the jack driver includes a coupling shaft having a groove, the first end of the handle arm forms a socket receiving the coupling shaft, the clip encircles the periphery of the handle arm at the socket, the handle arm has an opening at the socket, and the protrusion of the clip extends through the opening and into the groove to interlock the jack driver with the handle arm.

17. A jack handle comprising, in combination:

a handle arm having first and second ends;

a jack driver having a coupling shaft having a groove encircling a longitudinal axis of the coupling shaft;

wherein the groove extends radially inwardly about a periphery of the coupling shaft to form opposite and axially-facing first and second abutments;

wherein the first end of the handle arm forms a socket receiving the coupling shaft; and a spring clip operatively secured to the handle arm and having a protrusion resiliently deflectable between a locking position interlocking with the groove to limit axial movement between the jack driver and the handle arm by engagement between the protrusion and the first and second abutments and a releasing position free of the groove such that the jack driver is released from the handle arm.

18. The jack handle according to claim 17, wherein the spring clip has a pair of the protrusions which extend into opposite lateral sides of the groove.

19. The jack handle according to claim 17, wherein the spring clip substantially encircles a periphery of the handle arm at the socket, the handle arm has an opening at the socket, and the protrusion of the spring clip extends through the opening to the coupling shaft to interlock the jack driver with the handle arm.

20. The jack handle according to claim 17, wherein the groove is located within the socket when the coupling shaft is within the socket.

* * * * *